US006135813A

United States Patent [19]

Philippe

[11] Patent Number: 6,135,813

[45] Date of Patent: Oct. 24, 2000

[54] SOLDERABLE CLIP FOR A CONNECTOR WITH RIGHT-ANGLED CONTACTS

[75] Inventor: Jacky Philippe, Houtaud, France

[73] Assignee: Framatome Connectors International, Courbevoie, France

[21] Appl. No.: 09/313,800

[22] Filed: May 18, 1999

[30] Foreign Application Priority Data

May 25, 1998 [FR] France ..... 98 06543

[51] Int. Cl.[7] ..... H01R 13/73; H01R 4/01

[52] U.S. Cl. ..... 439/571; 439/79

[58] Field of Search ..... 439/567, 571, 439/79, 607, 609, 82, 108

[56] References Cited

U.S. PATENT DOCUMENTS

| | | | |
|---|---|---|---|
| 5,145,407 | 9/1992 | Obata et al. | 439/567 |
| 5,249,983 | 10/1993 | Hirai | 439/573 |
| 5,356,313 | 10/1994 | Niwa et al. | 439/567 |
| 5,468,154 | 11/1995 | Yip et al. | 439/79 |

FOREIGN PATENT DOCUMENTS 0 676 832 A1 10/1995 European Pat. Off. .

OTHER PUBLICATIONS

French Search Report.

*Primary Examiner*—Renee Luebke
*Assistant Examiner*—Antoine Ngandjui
*Attorney, Agent, or Firm*—Perman & Green, LLP

[57] ABSTRACT

The invention relates to a harpoon-type clip (1) for positioning, on a printed circuit, a connector fitted with right-angled contacts, the clip (1) having two parallel resilient arms (4, 6) provided at their respective ends (8) with a protuberance (10) which is intended to ensure that the connector is retained on the printed circuit.

According to the invention, each of the arms (4, 6) has at least one lug (12) extending towards the other arm, the lugs (8) being intended to be soldered after the connector has been fitted onto the printed circuit, so as to prevent the clip (1) from becoming detached from the printed circuit.

6 Claims, 3 Drawing Sheets

SOLDERABLE CLIP FOR A CONNECTOR WITH RIGHT-ANGLED CONTACTS

BACKGROUND OF THE INVENTION

The invention relates to a clip and to a method of positioning, on a printed circuit for example, a connector, fitted with right-angled contacts for example, of the DIN type, of the D type, of the Sub-D type, of the power plug type, etc.

The invention relates more particularly to a harpoon-type clip having two parallel resilient arms provided at their respective ends with a protuberance which is intended to ensure that the connector is retained on the printed circuit.

These metal clips are known and allow the connector to be positioned, by pressing it down, once inserted into the printed circuit, being retained by means of the resilient arms of the harpoon. Having thus prepositioned the connector on the printed circuit, the right-angled contacts of the connector are then soldered, generally by wave soldering.

With this type of connector, thus soldered and held in place on the printed circuit practically only by means of the contacts, it has been found that there is often a problem when transporting or using the latter. This is because a side impact may lift it, twisting the right-angled contacts, and thus moving it away from its nominal use position.

U.S. Pat. No. 5,468,154 describes a connector fitted with right-angled contacts using such metal retention clips intended for holding it in place and for positioning it on a printed-circuit board in order to be welded thereto. FIG. 1 shows diagrammatically a clip 1 of the prior art, having two arms 4 and 6. Because the arms 4 and 6 are too far apart, the probability of the process of soldering them being correctly carried out, or simply of being possible, is very low. Consequently, only the contacts are therefore soldered and allow the connector to be held in place on the printed circuit.

A known solution for solving this problem consists in soldering the harpoon(s) to the printed circuit.

This solution involves metallizing the printed circuit at the location of the harpoons, which means that the printed-circuit boards then have to be modified and hence they will be more costly.

SUMMARY OF THE INVENTION

The object of the invention is to provide a solution which does not have the drawbacks of the prior art described above.

According to the invention, each of the arms of the clip has at least one lug extending towards the other arm, the said lugs being intended to be soldered after the connector has been fitted onto the printed circuit so as to prevent the clip from becoming detached from the said printed circuit.

Such keys provided with lugs thus allow the connector to be resiliently prepositioned effectively, before wave soldering, as with the harpoon of the prior art, but also allow the connector to be positively fixed after soldering, the connector, thus held in position, necessarily remaining in its nominal use position, this being achieved without in any way modifying the printed circuit.

BRIEF DESCRIPTION OF THE DRAWINGS

Further features and advantages of the invention will emerge from the description which follows, given by way of non-limiting example, and with reference to the appended figures in which.

DETAILED DESCRIPTION OF THE INVENTION

Figure 1:
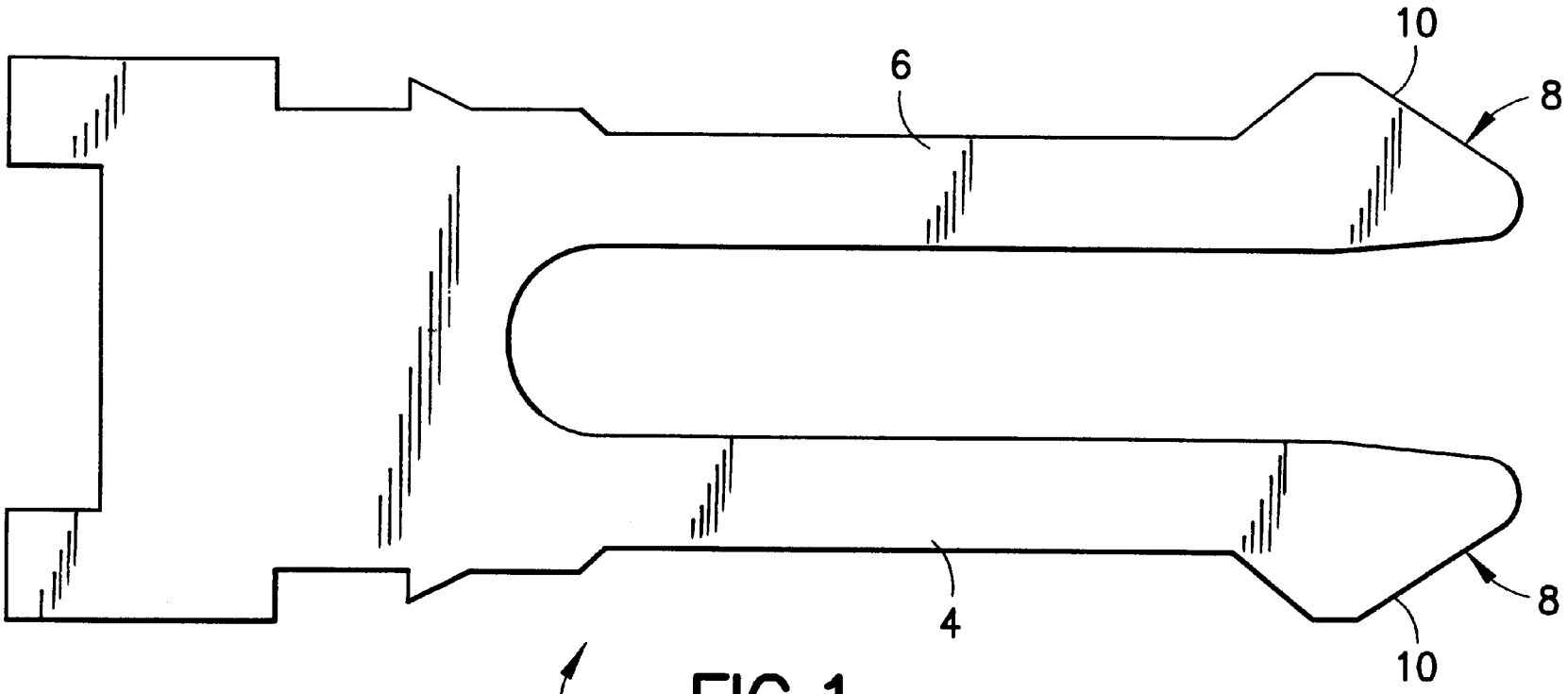
FIG. 1 PRIOR ART
FIG. 1 shows diagrammatically a clip of the prior art.
Figure 2:
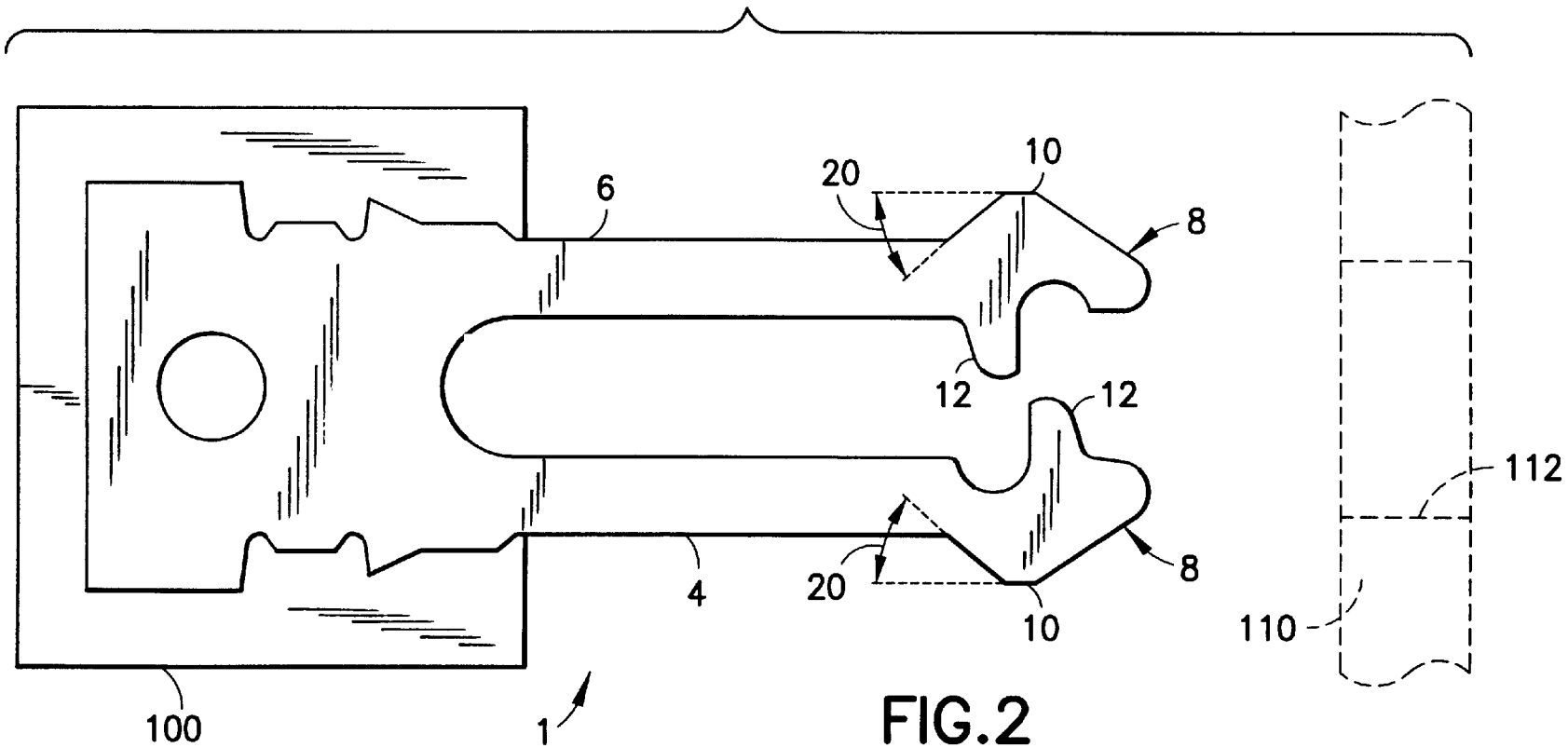
FIG. 2 shows diagrammatically a clip according to the invention.

In the rest of this description, the elements common to FIGS. 1 and 2 will be denoted by the same references.

Figure 3:
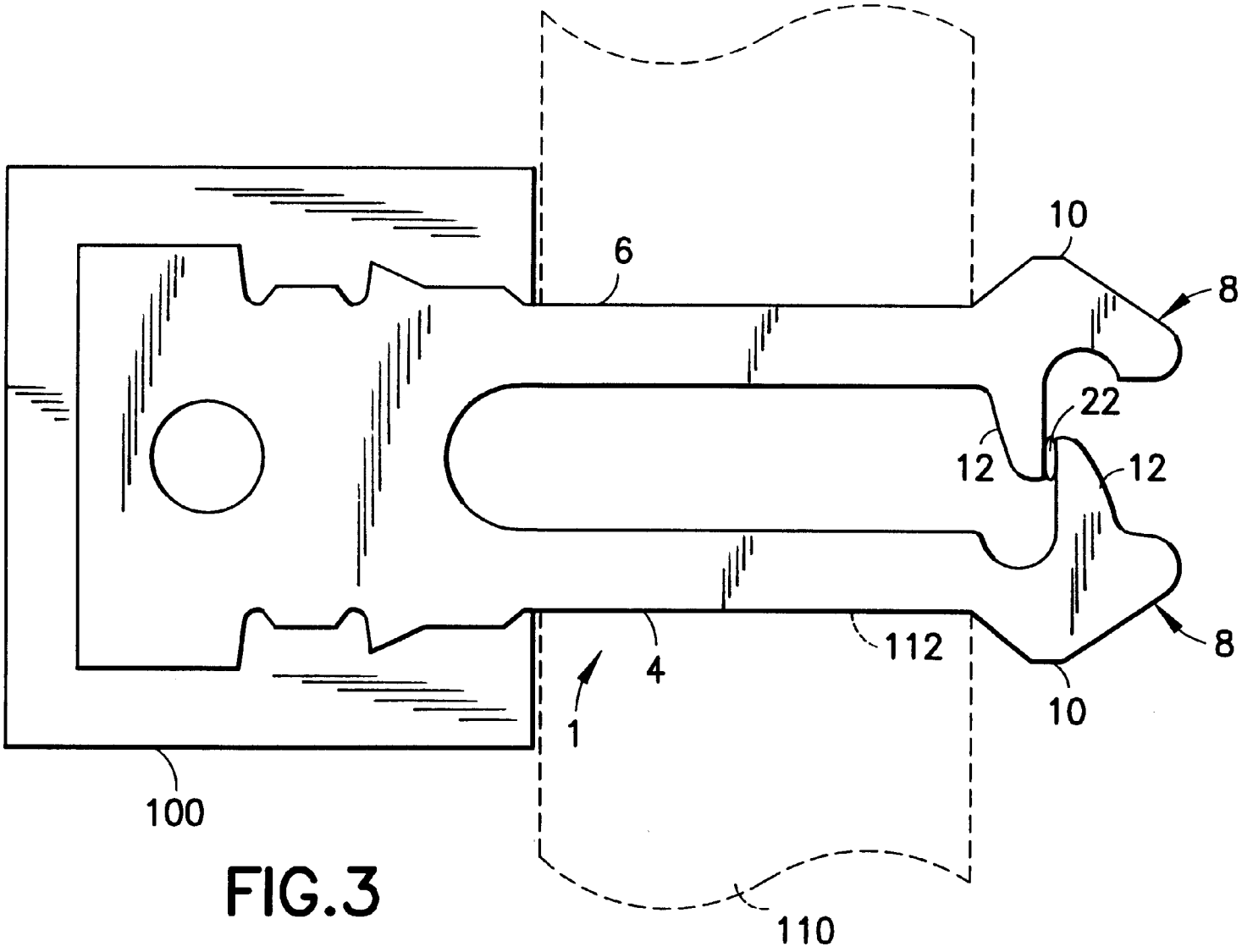

FIG. 3 shows a clip 1 of the harpoon type, having two parallel resilient arms 4 and 6 provided at their respective ends 8 with a protuberance 10 which is intended to ensure retention of a connector 100 on a printed circuit 110.

As may be seen in this figure, each of the said arms 4 and 6 has at least one lug 12 extending towards the other arm, the said lugs 12 being intended to be soldered after the connector has been fitted onto the printed circuit, so as to prevent the clip 1 from becoming detached from the said printed circuit.

According to a preferred embodiment of the invention, the said lugs 12 are offset one with respect to the other, in such a way that they can cross when the connector is being fitted onto the printed circuit.

Thus, because of their proximity, the lugs 12 can be soldered when the solder wave passes, the arms then being correctly soldered 22 to each other, even if only by the capillary effect.

As may be seen in FIG. 2, the protuberances 10 for retention of the clip 1 on the printed circuit have an approximately triangular shape, with a retention angle 20 of about 45°.

With such a structure, the positioning of the connector onto the printed circuit consists in fitting the clip 1 into a housing 112 provided for this purpose on the printed circuit and, when the wave passes, in soldering the arms 4 and 6 of the harpoon so as to prevent it from leaving the said housing.

What is claimed is:

1. Harpoon-type clip (1) for positioning, on a printed circuit, a connector fitted with right-angled contacts, said clip (1) having two parallel resilient arms (4, 6) provided at their respective ends (8) with a protuberance (10) for retaining connector on the said printed circuit, characterized in that each of said arms (4, 6) has at least one lug (12) extending towards the other arm, said lugs being soldered after the connector has been fitted onto the printed circuit, so as to prevent the clip (1) from becoming detached from said printed circuit, and said lugs being offset one with respect to the other, in such a way that they can cross when the connector is being fitted onto the printed circuit.

2. Clip according to claim 1, characterized in that said arms (4, 6) are wave soldered.

3. Clip according to claim 1, characterized in that the protuberances (10) for retention of the clip (1) on the printed circuit have an approximately triangular shape, with a retention angle (20) of about 45°.

4. Method of positioning a connector on a printed-circuit board by means of a harpoon-type clip (1) according to claim 1, characterized in that the clip (1) is fitted into a housing provided on the printed circuit and arms (4, 6) of the said clip are soldered so as to prevent it from leaving said housing.

5. Connector, characterized in that the connector has at least one clip according to claim 1.

6. In a harpoon clip for fitting a connector on a printed circuit, the clip comprising two substantially parallel resilient arms for retaining the clip to the printed circuit, each resilient arm having a protuberance thereon at an end of the arm for engaging the arm to the printed circuit, wherein the improvement comprises:

each resilient arm having at least one lug extending towards the other arm, the lugs being soldered to each other after the connector is fitted on the printed circuit, each lug being located on the arm, and being sized and shaped so that when the lugs are soldered together, the soldered lugs fixedly hold the resilient arms and prevent the clip from being detached from the printed circuit.

* * * * *